United States Patent [19]

Howell et al.

[11] 4,444,519

[45] Apr. 24, 1984

[54] PRINTERS

[75] Inventors: Fred M. Howell, Amherst; Theodore J. Goodlander, 181 Coburn Woods, Nashua, N.H. 03063; Duarte M. Brazao, Nashua, N.H.

[73] Assignee: Theodore Jay Goldlander, Nashua, N.H.

[21] Appl. No.: 356,320

[22] Filed: Mar. 9, 1982

[51] Int. Cl.[3] ..... B41J 3/54; B41J 3/12; B41J 1/30

[52] U.S. Cl. ..... 400/82; 101/93.04; 101/93.12; 400/124; 400/144.2; 400/149; 400/229

[58] Field of Search ..... 400/82, 124, 144.2, 400/144.3, 149, 320; 101/93.04, 93.05, 93.12, 93.17–93.19

[56] References Cited

U.S. PATENT DOCUMENTS

| | | | |
|---|---|---|---|
| 4,126,400 | 11/1978 | Suzuki et al. | 400/144.2 |
| 4,239,400 | 12/1980 | Giolitti | 400/144.2 |
| 4,389,126 | 6/1983 | Honma et al. | 400/82 |

*Primary Examiner*—Paul T. Sewell

*Attorney, Agent, or Firm*—Hayes, Davis & Soloway

[57] ABSTRACT

A printer capable of operation as a dot matrix printer, and, alternatively, as a daisy wheel printer, the printer including the carriage providing for the mounting of a daisy wheel and associated hammer solenoid or a dot matrix printhead, the carriage including a diasy wheel drive mechanism and means for automatically selecting a mode of operation consistent with the mode of printing desired.

10 Claims, 17 Drawing Figures

PRINTERS

The present invention relates to improvements in printers and in particular, though not exclusively, to a printer capable of both solid character printing and dot matrix printing.

As used herein "solid character" refers to the printing of alpha-numeric characters and symbols utilizing master characters and symbols identical with the desired printed image. As used herein "dot-matrix" relates to the creation of a printed image approximating a desired printed image by the creation of a plurality of individual dots produced by the selected activation of one or more of a plurality of print wires arranged in a fixed spaced relationship in a print head.

Many types of printers have been proposed for use in providing a printed output from automated machines including word processors and computers. All of the printers of which applicant is aware have utilized one specific type of printing mechanism, for example, a daisy wheel, spherical ball element, a dot matrix printhead, ink jets et cetera. In general, these printers can be divided into two groups capable, the first of which is capable of producing a good quality (letter quality) printed image at a relatively low speed and the second of which is capable of producing a less than letter quality printed image at a relatively high speed. Typically letter quality printing may be achieved, today, by a daisy wheel printer such as is commonly found in combination with a word processing unit, with a printing rate not exceeding 40 to 50 characters per second if substantial mechanical complexity and associated high costs are to be avoided. Even at this rate of printing, a daisy wheel printer may cost two to six thousand dollars and be mechanically quite complex. Quite apart from the relatively high cost of manufacturing such complex printers, the mechanisms concerned involve substantial costs in research and development and are apt to be less than desirably reliable in use, thereby leading to the use of relatively expensive service contracts under normal circumstances. While for the printing of the majority of documents requiring letter quality printing, a daisy wheel printer of relatively simple construction with a printing rate of 15 to 20 characters per second might well prove acceptable to most businesses, there is substantial pressure to increase the rate of printing of these printers in order that they may serve the dual function of printing documents requiring letter quality printing and the printing of documents such as business forms, accounts, lists, drafts, inventories, statistics, et cetera which do not require letter quality printing but which often are required in such bulk that high speed printing is required for the purposes of economy and early access to the information concerned. Currently even the highest speed daisy wheel printers cannot exceed 100 characters per second and such speeds are approached only in the most sophisticated, complex and expensive daisy wheel printers. Other solid character printers are even slower.

Dot matrix printers, on the other hand, are capable of printing speeds well in excess of 100 characters per second and are well suited to the preparation of such documents as business forms, accounts, lists, drafts, inventories, statistics et cetera at the high speeds desired for such printing. However, a typical dot matrix printer is not capable of producing a letter quality printing. In an attempt to improve the quality of dot matrix printing so that it approaches the quality of the continuous character printing of a daisy wheel printer, several attempts have been made to increase the number and density of dots utilized to generate a printed character and to place these most effectively. This is achieved by increasing the number of print wires in the print head and/or by utilizing multiple overpass printing actions of the dot matrix printhead. These attempts to increase quality of the printed image produced by the dot matrix printer, needed only where the use of the printer is desired to produce letter quality printing, perhaps a small percentage of the printer's utilization, results in such machines becoming complex, expensive and undesirable in much the same way as is the usually more complex daisy wheel printer.

Until the present invention, with its relative low price and relative simplicity, the provision of both letter quality document production and high speed lower quality printing has required the purchase of two printers, namely a dot matrix printer and one of the various printers available which will produce a solid printed character.

Quite apart from overall printer design, dot matrix printheads currently available are expensive to produce with the constructions usually being difficult to assemble and service.

It is an object of the present invention to overcome the conflicting requirements of speed and a high quality printed image in a single printer of relatively simple reliable construction at a moderate price.

It is a further object of the present invention to provide improved mechanisms for carriage drive, ribbon drive, platen pressure roller operation, daisy wheel drive, print head position detection, carriage release, et cetera.

It is a further object of the present invention to provide a dot matrix printhead which is economical to manufacture, which uses less than usually sophisticated materials and which is easy to assemble.

According to the present invention, there is provided apparatus, for a printer, comprising a device adapted to provide for a solid character printing mode of operation and a dot matrix mode of operation, and a selector operable to select a desired said mode.

According to the present invention, there is also provided a printer for printing in a solid character mode and a dot matrix mode as desired, comprising:

a printer main frame;

a platen mounted in said main frame;

an elongate carriage support rigidly mounted to said main frame parallel to said platen;

a guide rail in fixed spaced parallel relationship to said carriage support;

a carriage supported by said carriage support and said guide rail for movement therealong and guidance thereby respectively, said carriage having a solid character printing element drive mechanism and mounting means for a dot matrix printhead;

selector means operable to select a desired said mode; and a control means for operating said printer in accordance with the printing mode selected.

According to the present invention, there is also provided a printer comprising:

a main frame;

a platen;

a carriage for carrying and operating a printing element; and a carriage driving mechanism for traversing the carriage along said platen, said mechanism consisting of a stepper motor and a transmission connected to said stepper motor to be driven thereby and to drive said carriage to traverse said platen with a transmission reduction ratio of 2:1 from the stepper motor to carriage movement.

Preferably, the cable and pulley transmission comprises a cable having first and second ends;

a drive pulley driven by said stepper motor and by which the cable, which is under tension, is driven;

a first idler pulley freely rotatable about an axis fixed relative to said carriage and about which said cable passes, with 180° of wrap, from said drive pulley to the first end of said cable, said first end being captively connected to said main frame adjacent one end of the carriage traverse along the platen; and a second idler pulley freely rotatable about an axis, parallel to or coincident with the first said axis, fixed relative to said carriage and about which said cable passes, with 180° of wrap, from said drive pulley to the second end of said cable, said second end being captively connected to said main frame adjacent the other end of the carriage traverse along the platen.

According to the present invention, there is also provided a printer comprising:

a main frame;

a platen;

a carriage for carrying and operating a printing element, said element being adapted to create an image by means of a ribbon carrying an image producing medium, means for traversing the carriage along the platen; and a ribbon drive mechanism consisting of a rotatable input member;

means for rotating said input member in one direction when said carriage traverses in one direction and in an opposite direction when said carriage traverses in a direction opposite said one direction of traverse;

a rotatable idler;

a toggle means movable between first and second positions adapted to support said idler for rotation by said input member;

a first ribbon spool drive;

one way drive means for bringing said idler into driving engagement with said first ribbon spool drive to rotate a spool, when mounted thereon, when said toggle is in said first position and only when said input member is rotated in said one direction of rotation;

a second ribbon spool drive; and means for moving said toggle means to said second position, said one way drive means bringing said idler into driving engagement with said second ribbon drive spool when said toggle means is in said second position and only when said input member is rotated in said opposite direction of rotation.

According to the present invention, there is also provided a dot matrix printhead having an outward wire guide means adjacent a printing surface, inward wire guide means, print wires having reinforced inner ends, more than one third of the inner end of each print wire being surrounded by reinforcing means.

According to the present invention, there is also provided a dot matrix printhead having an outward wire guide means adjacent a printing surface, inward wire guide means, an armature for driving each print wire outwardly and leaf spring means bearing on each wire outwardly of the inner guide means and forcing the wires inwardly against the armatures.

According to the present invention, there is also provided a dot matrix printhead having outward wire guide means adjacent a printing surface, inward wire guide means, print wires having reinforced inner ends, an armature for driving each print wire, a magnet core for each armature, said cores being arranged in a ring around the axis of the print head, a concave surface radially inwardly of the ring of magnet cores, a retaining cap extending radially outward from the axis and engaging each armature between the concave surface and its associated magnet core.

The invention will now be described, by way of example, with reference to the accompanying drawings, in which.

THE PRINTER

Figure 1:
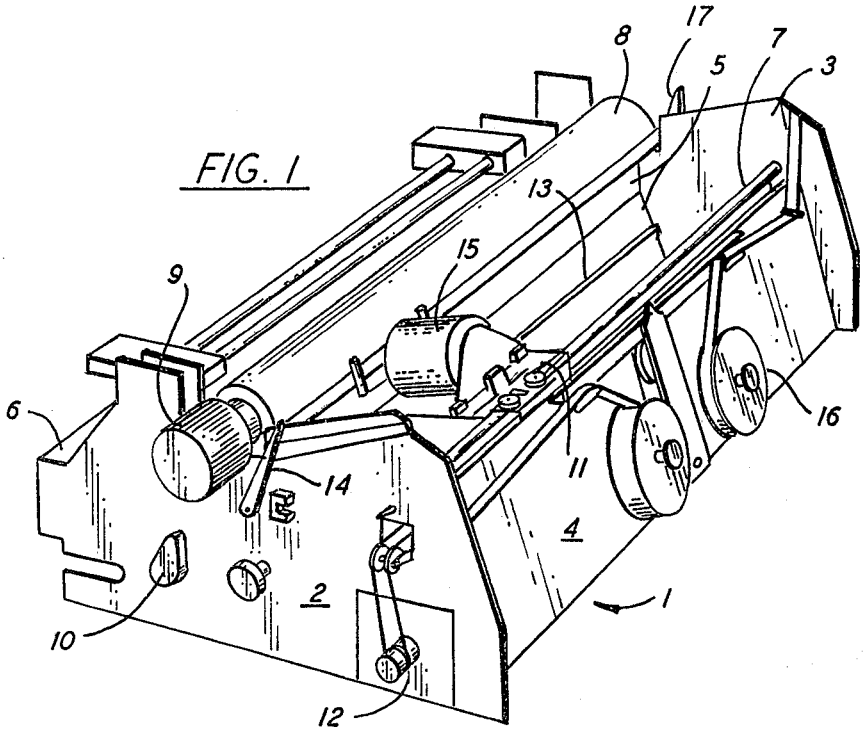
FIG. 1 is a diagrammatic perspective view of a printer according to the present invention.

With reference, initially, to FIG. 1, the printer has a main frame and support structure 1 including end plates 2 and 3 which are connected in spaced, parallel relationship by a front plate 4, paper path and carriage guide support members (shown generally at 5), a rear platform member 6, carriage support shaft 7 and other members (not shown) extending between the end plates 2 and 3.

A platen 8 is supported by the frame and support structure 1 for rotation manually by knob 9 and automatically by a stepper motor drive 10.

A carriage 11 is mounted on shaft 7 for movement therealong under the control of a carriage drive mechanism 12. The shaft 7 is parallel to the platen 8. The carriage is retained in a desired angular position about the shaft 7 by means of a guide rail 13, forming part of the paper path and carriage guide support members 5, from which it is releasable by the operation of a guide release mechanism operated by a guide release lever 14. The carriage incorporates mechanisms, interchangeable mounting arrangements and electrical connection arrangements permitting an operator to select, at will, solid character print operation utilizing a daisy wheel and hammer solenoid or dot matrix print, utilizing a dot matrix printhead 15, this latter being the form shown in place in FIG. 1. The selection of solid or dot matrix print is made by the operator by substituting the dot matrix print head 15 for a daisy wheel and hammer solenoid, and vice versa, utilizing the mounting arrangement which will be described in greater detail below.

The carriage drive mechanism 12 also drives a ribbon drive mechanism 16 utilizing a conventional multi-pass cloth spooled (typewriter style) ribbon with automatic reversal of ribbon motion, when the end of the ribbon is reached, and with transport of the ribbon only during movement of the carriage on one direction, the carriage itself being operable to print in both directions of carriage travel.

Figure 2:
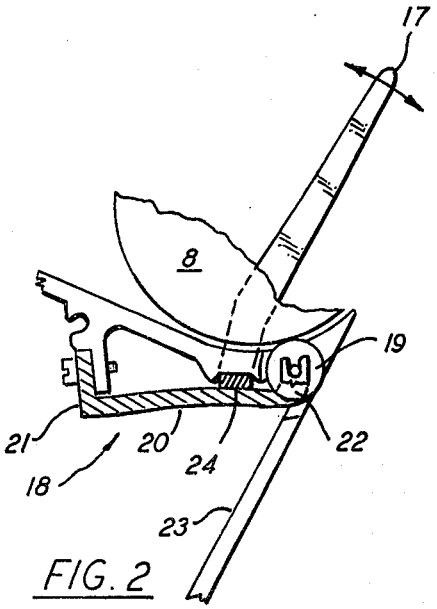
FIG. 2 is a diagrammatic sectional elevation of a pressure roller arrangement incorporated in the printer shown in FIG. 1.

A pressure roller lever 17 operates a plurality of like pressure roller arrangements (one of these arrangements 18 is illustrated in FIG. 2) to move pressure rollers from the position in which roller 19 is shown in FIG. 2, in which they are pressed against the outer periphery of platen 8, and a position in which they are disengaged from the periphery of platen 8. With reference to FIG. 2 roller 19 is mounted for rotation on a resilient molded one piece mounting bracket 20. Bracket 20 includes a mounting flange connected to roller bearing flanges 22 by a leaf spring member. The mounting flange 21 is rigidly attached to paper path guide member 23 forming part of the paper path and carriage guide support members 5.

The pressure roller operating lever 17 is attached to a rectangular cross-section cam 24 and is arranged to rotate this cam about a fixed axis relative to the main frame and support structure 1. The cam engages the leaf spring member (and the corresponding members of the other pressure roller arrangements) and, upon rotation, moves the roller between the platen engaging and disengaged positions by virtue of the action of the cam against the spring bias applied by the leaf spring. It will be appreciated that due to the rectangular cross section of the cam, the pressure roller arrangement will remain in either the platen engaging or disengaging positions of the rollers when the pressure roller operating lever is released with the rollers in either one of these two positions. In addition, it will be appreciated that the rectangular form of the cam will cause the pressure rollers to be biased to one or other of the platen engaging or disengaged positions when the lever is released in an intermediate position.

Figure 3:
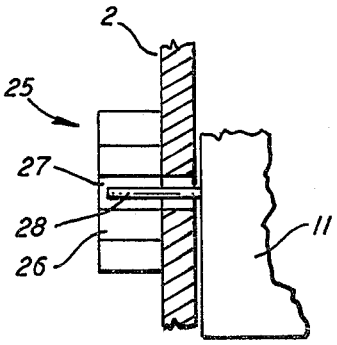
FIG. 3 is a diagrammatic sectional elevation of a carriage position detector of the printer of FIG. 1.

A carriage position detector 25 is mounted on end plate 2 and is arranged to detect the presence of the carriage in a desired position closely adjacent end plate 2. To this end, the detector 25 (see FIG. 3) includes a photoelectric detector arrangement 26 consisting of a light emitting diode and photosensitive transistor located one on either side of an opening 27 into which projects a tag 28 carried by the carriage 11 only when the carriage is in said desired location. In this location, the tag prevents the photosensitive transistor from detecting light emitted by the diode, while in other positions of the carriage, no such prevention occurs.

It will be appreciated that the carriage position detector could, alternatively, be mounted on the carriage with tags being placed at both ends of the carriage traverse to cooperate with the detector to detect the carriage at each extreme of its traverse.

THE CARRIAGE

Figure 4:
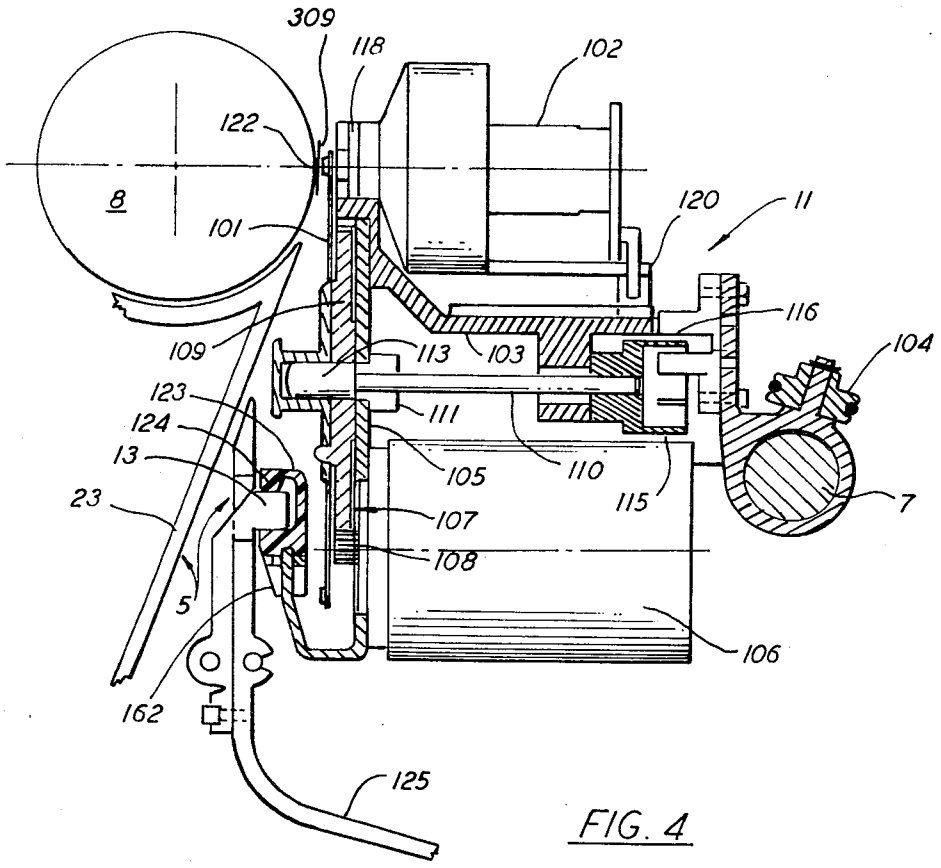
FIG. 4 is a diagrammatic sectional elevation of the carriage of the printer of FIG. 1, the section being taken in a plane normal to the axis of the platen of the printer, with the carriage shown in a daisy wheel operating mode.
Figure 5:
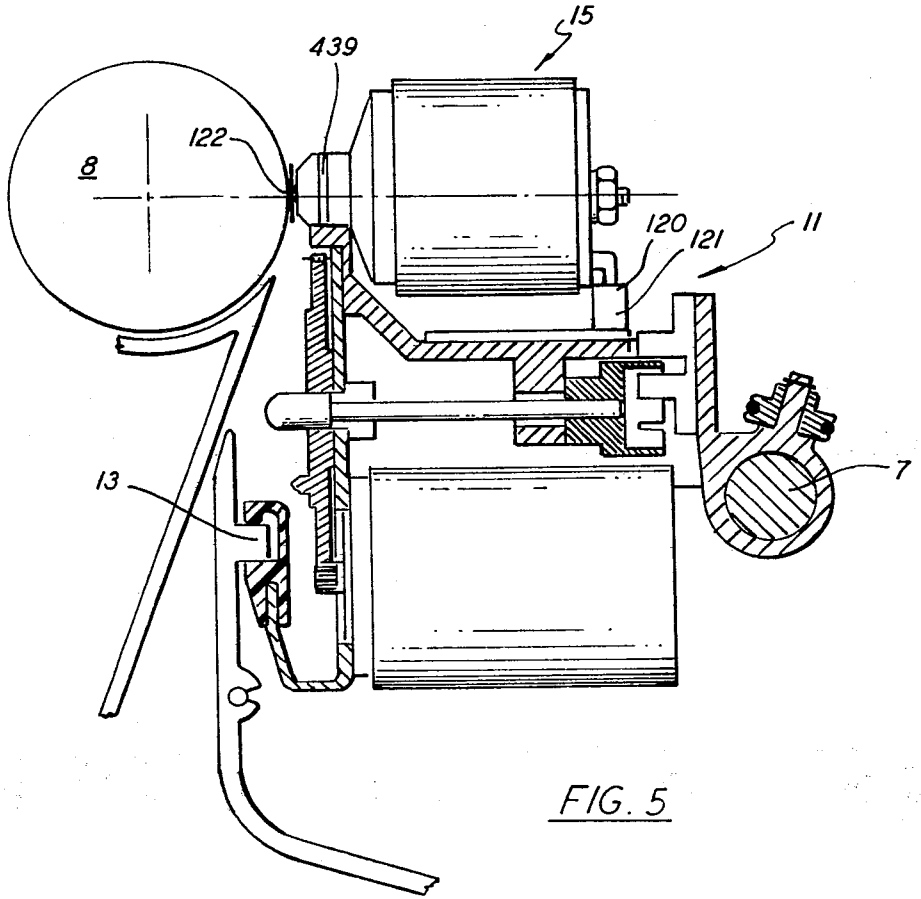
FIG. 5 is a diagrammatic sectional elevation similar to that of FIG. 4, with the carriage shown in a dot matrix operating mode.
Figure 6:
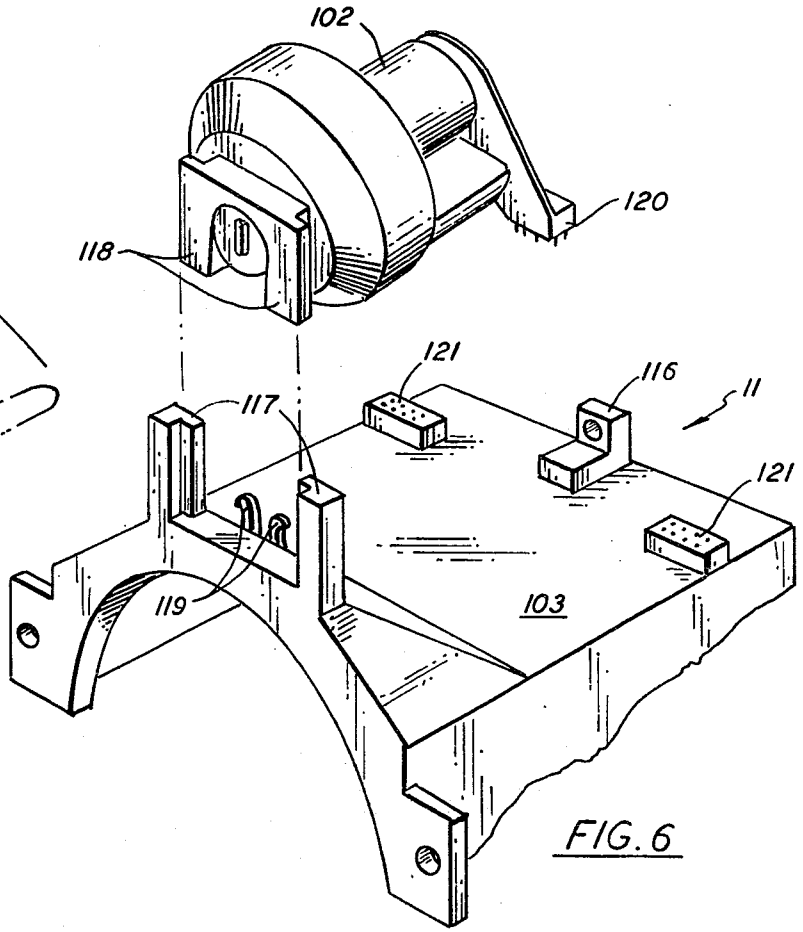
FIG. 6 is a diagrammatic representation of the upper portion of the carriage illustrating the mounting arrangements for a dot matrix head or hammer solenoid with a hammer solenoid being shown spaced from the carriage in alignment with its mounting arrangements.

The carriage 11, which is shown generally in FIG. 1, is illustrated in greater detail in FIGS. 4, 5 and 6. FIGS. 4 and 6 relate to the carriage in a solid character printing mode utilizing a daisy wheel 101 and hammer solenoid 102, while FIG. 5 shows the carriage in a dot matrix printing mode in which a dot matrix head 15 is substituted for daisy wheel 101 and solenoid hammer 102. The carriage arrangement will first be described in the solid character printing mode, with particular reference to FIGS. 4 and 6. A main carriage frame 103 is supported by shaft 7 for movement along shaft 7, under the control of the carriage drive mechanism 12, and for rotation through a sufficient angle about shaft 7 to provide ready access to daisy wheel 101 for attachment and detachment of that wheel from the carriage. The carriage drive mechanism 12 includes pulley 104 and will be described in detail below, with reference to FIGS. 8 and 9. While, in the embodiments particularly described, shaft 7 is rigidly mounted in the frame and support structure 1, it will be appreciated that other arrangements will fall within the scope of the present invention, including, for example, arrangements in which the shaft is rotatable relative to the frame and support structure 1 and/or is movable longitudinally with respect to that structure with the carriage being connected to the shaft in such a manner as to provide the desired longitudinal movement of the carriage relative to the platen and to the necessary access to the daisy wheel 101. Further, it will be appreciated that embodiments in which the carriage is maintained stationary relative to the frame and support structure 1 while the platen 8 is moved longitudinally during the printing operation, will also fall within the scope of the invention. In the best mode of performing the invention, currently known to applicants, the shaft 7 is rigidly attached to the frame and support structure 1 with the carriage being arranged for movement along the shaft and for rotational movement about the shaft for access to the daisy wheel.

Rigidly attached to the front face of the main carriage frame 103 is a daisy drive and carriage guide mounting plate 105, which supports a daisy drive stepper motor 106 and a daisy drive transmission 107 consisting of a driving gear 108 and a driven gear 109. The driving gear is supported by the drive shaft of the stepper motor 106, while the driven gear is rigidly supported by a daisy wheel mounting shaft 110 which is journalled in a first bearing 111 supported by the mounting plate 105 and a second bearing 112 supported, in fixed spaced relationship to the first bearing 111, by the main carriage frame 103. The end 113 of the shaft 110 adjacent the driven gear 109 carries a conventional daisy wheel mounting nose and the driven gear 109 has a projection 114 arranged to engage an opening in a daisy wheel 101 to locate said daisy wheel angularly relative to the driven gear and to provide positive rotation of the daisy wheel by the driven gear.

The end of shaft 110, remote from the daisy wheel mounting, supports a slotted drum 115, this drum being rigidly attached to the shaft 110 for rotation therewith. A photoelectric detector 116 similar to detector 26 is mounted rigidly on the main carriage frame 103. The cylindrical annular portion of the slotted drum 115 is positioned to rotate through the opening of the detector 116 between the light emitting diode and the photosensitive transistor whereby once during each revolution of the daisy wheel 101, drive gear 109, shaft 110 and slotted drum 105, the drive positions the slot between the light emitting diode and the photosensitive transistor to allow light to pass therebetween. This provides a signal by which an initial position of rotation of the daisy wheel may be determined.

Two guide bars 117 project from the top of the main carriage frame 103 and these are dimensioned to accept and cooperate with corresponding guide bars of the hammer solenoid 102 for location of that solenoid relative to the main carriage frame. Resilient latches (see FIG. 6) project from the main carriage frame 103 adjacent guide bars 117 to engage detents (not shown) formed on the hammer solenoid 102. These latches provide a retaining force between the hammer solenoid 102 and the main carriage frame 103. The rear of the hammer solenoid 102 carries an electrical connecting circuit board which connects the solenoid by way of two connectors 120 (only one of these being shown), when the hammer solenoid 102 is mounted on the main carriage frame 103, to corresponding connectors 121 supported rigidly on the main carriage frame 103. The connectors 120 and 121 are spaced in order that they assist the guide bars 117 and 118 and latches 119 in steadying and locating the hammer solenoid 102 on the main carriage frame 103. The connectors 120 and 121 provide the necessary interconnection of the electronic circuitry of the printer and the hammer solenoid 102, while simultaneously providing necessary electrical interconnection between pins or sockets of connectors 121 for proper operation of stepper motor 106 and selection of appropriate operating characteristics for operation when in the daisy wheel mode illustrated in FIGS. 4 and 6. A similar arrangement on dot matrix head 15 provides connection with connectors 121 when the dot matrix head 15 is mounted on the main carriage frame 103 thereby, in that dot matrix operating mode, to ensure correct operation of the printer, by the printer control circuitry, as a dot matrix printer.

Although the interconnection of the hammer solenoid 102 or dot matrix head 15 with the main carriage frame 103 has been described with reference to connectors 120 and 121, it will be appreciated that while electrical interconnection between these members is required, this need not form part of the structural mounting of the solenoid or head to the main carriage frame. Further, the necessary switching between the two modes of operation, namely the daisy wheel print mode and the dot matrix mode, could be achieved by manual switching or by electromagnetic switching, etc., without departing from the inventive concept of this invention.

The geared stepper motor drive for the daisy wheel 101 provides clearance on the carriage for the mounting of a dot matrix head (FIG. 5) while permitting the impact area 122 of the dot matrix wires to be coincident with the impact area of the characters on the petals of the daisy wheel 101 when the printer prints in these alternative modes of operation. In addition, the gearing permits a significant reduction in inertia at the stepper motor 106. There are 96 petals, or characters, on the daisy wheel 101 and when a 45° stepper motor 106 (i.e., 8 steps/revolutions) is used, a gear ratio of 12:1 between the driving and driven gears 108 and 109 is required. This gearing results in a reduction of the inertia at the motor of 144:1 by comparison with an arrangement in which the daisy wheel is driven directly by the stepper motor.

Mounting plate 105 carries carriage guide bearing 123. This bearing is made of a lubricant filled plastic and is arranged to engage guide rail 13 to locate the carriage 11 angularly about shaft 7. The top bearing runner 124 of the guide bearing 123 is constructed so as to be resilient to an extent sufficient to accommodate variations in the guide 13 which forms part of a structural aluminum member 125, which in turns forms part of the frame and support structure 1.

FIG. 5 illustrates a dot matrix operating mode of the carriage 11, in which daisy wheel 101 and hammer solenoid 102 have been removed and a dot matrix head 15 has been substituted for the hammer solenoid 102 with connectors 120 and 121 performing the necessary interconnection and switching for the printer to be operated as a dot matrix printer. Although FIG. 5 shows a similar cross-sectional elevation to that shown in FIG. 4, the carriage 11 in FIG. 5 is in a different position along shaft 7 and guide rail 13, with the result that structural elements of the guide release mechanism operated by the guide release lever 14 do not appear in FIG. 5. While the daisy wheel drive mechanism has been described with reference to a simple gear drive with a 12:1 ratio, it will be appreciated that belt (cogged or plain), cable, anti-backlash drives, etc., could be utilized without departing from the concepts of the present invention as could other ratios or a direct daisy wheel drive in combination with an appropriate form of stepper motor.

CARRIAGE RELEASE

Figure 7:
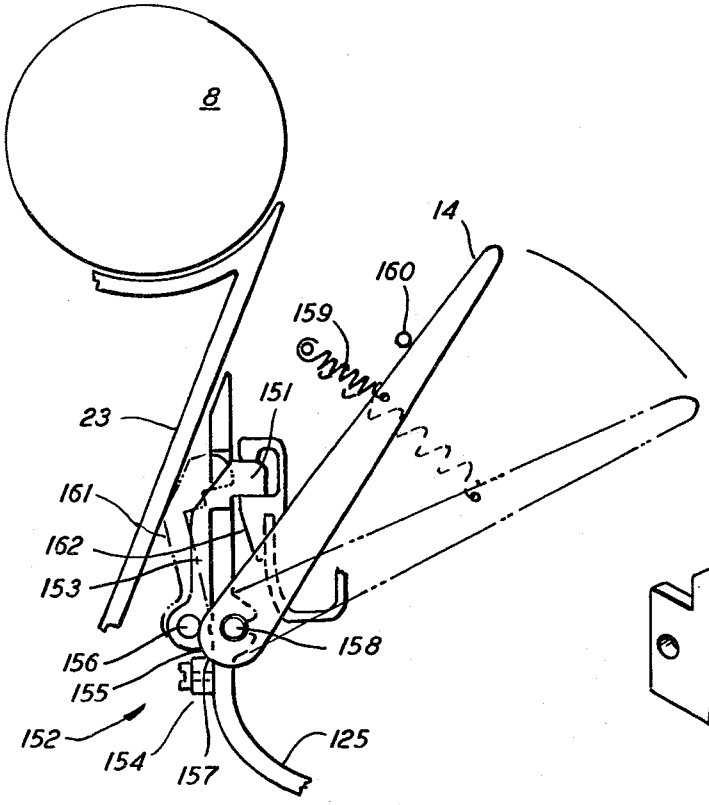
FIG. 7 is a diagrammatic representation of the carriage release mechanism of the printer of FIG. 1.

A carriage release mechanism is illustrated in FIG. 7. This mechanism releases the carriage 11 from guide rail 13 to permit the carriage to be rotated about shaft 7 for access to the daisy wheel 101.

The guide rail 13 is divided into two aligned contiguous parts, a first part integrally formed with member 125 and a second part 151 adjacent end plate 2 at the location at which the carriage 11 activates the photoelectric detector 26. The carriage release mechanism 152 includes a one piece arm 153 rigidly attached at one end 154 to member 125 and carrying, at its other end, the second guide rail part 151. The arm 153 is provided with a resilient hinge 155 adjacent said one end 154 and with a cam follower 156 disposed between the resilient hinge 155 and the second guide rail part 151 in engagement with the cam surface 157 of the guide release lever 14. The guide release lever 14 is pivoted on part 125 by means of a pivot 158 and is biased by a coil tension spring 159 in an anti-clockwise direction as shown in FIG. 7 against a stop 160. The spring is connected between the lever 14 and end plate 2 (not shown in FIG. 7) and the stop 160 is rigidly mounted on that end plate 2.

Upon movement of lever 14 in a clockwise direction into the position shown in ghost in FIG. 7, the cam surface 157 acts on the cam follower 156 to move the arm 153, against the resilience of hinge 155, into the position shown in ghost at 161, thereby to move the second guide rail part 151 from engagement with the carriage guide bearing 123 so as to release the carriage 11 and permit its rotation about shaft 7.

Once the lever 14 is released, thereby to return under the influence of spring 159 to its position against stop 160, the carriage 11 can be returned to the position in which its guide bearing 123 engages rail 13 simply by pivoting the carriage in an an anti-clockwise direction as seen in FIG. 4 so that ramp 162 engages the second guide rail part 151 and moves this against the resilience of hinge 155 until the second guide rail part 151 can return to the position shown in FIG. 4 in which it fits within the carriage guide bearing 123 in contact with the upper bearing runner 124.

CARRIAGE DRIVE MECHANISM

Figure 8:
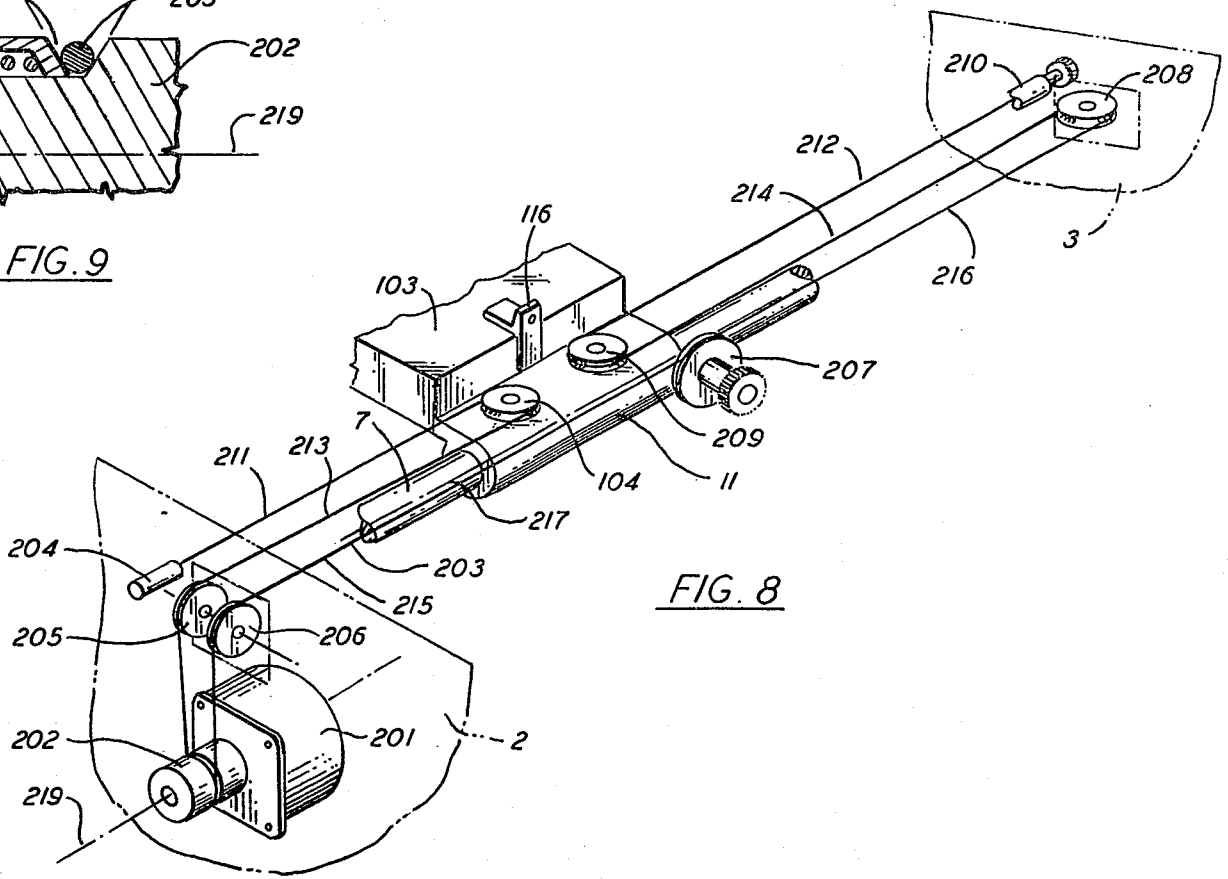
FIG. 8 is a diagrammatic perspective representation of the carriage drive arrangements of the printer of FIG. 1.

The carriage drive mechanism is illustrated in FIG. 8. The carriage drive mechanism 12 consists of a cable drive having a drive ratio reduction of 2:1 between the input to the cable at stepper motor 201 relative to movement of the carriage 11 by the drive mechanism resulting from the operation of the stepper motor. The stepper motor is rigidly attached to end plate 2 and carries a drive pulley 202, which engages a cable 203 under tension to transmit motion thereto. The cable 203 is supported at one end and located relative to end plate 2 by a nipple 204. From this nipple, the cable extends to and around pulley 104 of carriage 11 with approximately 180° of wrap. The pulley 104 is mounted on the carriage 11 and is freely rotatable about its axis relative to the carriage. From pulley 104, the cable passes over an idler pulley 205 mounted on end plate 2, around pulley 202, again with approximately 180° of wrap, to idler pulley 206, which is also mounted on end plate 2 and which is axially aligned with idler pulley 205. From idler pulley 206, the cable passes by way of a ribbon drive pulley 207 to an idler pulley 208 attached to end plate 3. The cable has three complete wraps about ribbon drive pulley 207 and serves to provide drive for the ribbon mechanism 16. Apart from receiving drive from the cable, ribbon drive pulley 207 plays no part in the operation of the carriage drive mechanism.

The cable is wrapped approximately 180° about pulley 208 and from there passes to a pulley 209 mounted on carriage 11 for free rotation relative thereto about an axis parallel to the axis of pulley 104. The axes of pulleys 104 and 209 are spaced apart longitudinally of the shaft 7 and are diposed normal to the axis of shaft 7. The cable has approximately 180° of wrap about pulley 209 and from there extends to end plate 3, where it is supported and restrained by an adjustable nipple 210. The adjustable nipple 210 adjusts to provide adjustment of the tension of the cable 203 throughout the carriage drive mechanism. Portions 211, 212, 213, 214, 215 and 216 of cable 203 are all parallel to the longitudinal axis 217 of shaft 7, with portions 211 and 212 being axially aligned portions 213 and 214 being axially aligned, and 215 and 216 being axially aligned. Carriage pulleys 104 and 109 are disposed as close as can be conventionally arranged to the shaft 7 in order to permit desired rotation of the carriage 11 about shaft 7 without unduly stretching or disturbing the cable arrangement.

Stepper motor 201 provides 48 steps/revolution and the effective drive diameter of pulley 202 is chosen to drive the carriage 11 longitudinally on shaft 7, by way of the 2:1 drive ratio reduction of the cable arrangement, at 60 steps per inch of travel. This permits the ready provision of the standard print character spacing of 10 characters/inch or 12 characters/inch.

Figure 9:
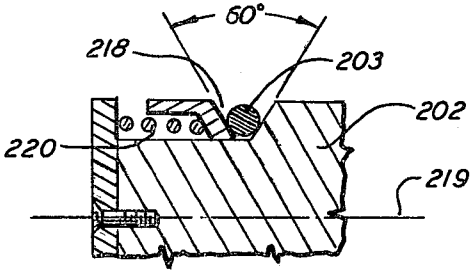
FIG. 9 is a fragmentary sectional elevation of one form of drive motor pulley of the carriage drive shown in FIG. 8.

FIG. 9 shows an alternative embodiment to that shown in FIG. 8 in which drive pulley 202 provides additional frictional engagement of the cable 203 to provide a more positive drive of that cable 203. In this embodiment the pulley has a cable engaging groove 218 with walls having an included angle of 60°. The pulley is a multi-part assembly in which the walls are resiliently biased toward each other, axially of the pulley axis 219, by a spring 220. The bias is sufficient to provide a desired frictional grip on the cable while permitting the cable to seat on the cylindrical base surface of groove thereby providing a constant drive radius for the pulley.

It will be appreciated that while the carriage drive mechanism has been described with reference to a cable, the invention encompasses also the use of other elongate flexible drive members including tapes (cogged or smooth), ladder tapes, etc.

RIBBON DRIVE MECHANISM

Figure 10:
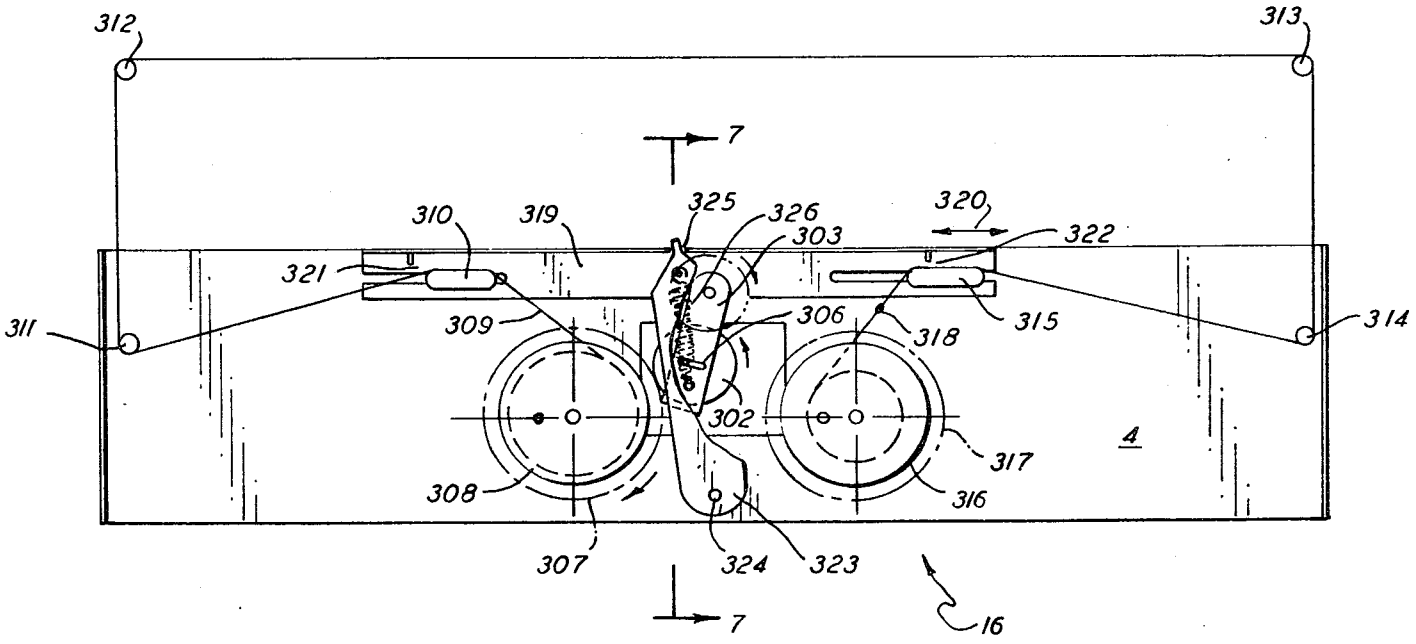
FIG. 10 is a diagrammatic partially broken away front elevation of a first embodiment of a ribbon drive of the printer of FIG. 1.
Figure 11:
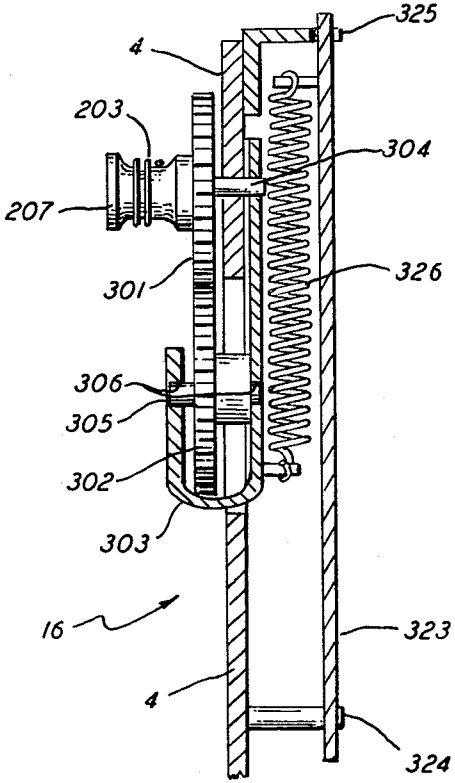
FIG. 11 is a diagrammatic cross-sectional elevation on section lines 7—7 of FIG. 10.

With reference to FIGS. 10 & 11 the ribbon drive mechanism is mounted on front plate 4 with pully 207 projecting to cooperate the cable 203 to receive drive therefrom. Rigidly connected for rotation with pully 207 is a drive gear 301. As, during operation, the carriage oscillates along shaft 7 from one end thereof to the other and back again, under the control of stepper motor 201, the pulley 207 and drive gear 301 will be turned alternatively clockwise and counterclockwise. An idler gear 302 is held in mesh with the drive gear 301 by a pivot link 303 which is free to rotate about shaft 304 of the drive gear. The shaft 305 of idler gear 302 is captive in a slotted bearing hole 306 in the pivot link 303. The orientation of the slotted bearing hole is such that movement of the shaft 305 along this slot will not interfere with the constant mesh of the drive gear 301 and idler gear 302. The slotted arrangement for mounting the idler gear to the pivot link as observed in FIG. 10 results in the idler gear being moved to the left hand end of the slotted bearing hole 306 when the drive gear is rotated in a clockwise direction and this movement, when the pivot link 303 is in the position shown in FIG. 10, brings the idler gear into mesh with a left hand ribbon drive gear 307 to rotate the gear 307 in a clockwise direction. The left hand ribbon drive gear drives a ribbon spool drive plate and shaft upon which is mounted a ribbon spool 308. Rotation of ribbon spool 308 in a clockwise direction by the left ribbon drive gear 307 winds ribbon 309 onto this spool which in this mode acts as a take-up spool. For clarity FIG. 10 shows the ribbon path diametrically as passing over guides 310, 311, 312, 313, 314 and 315 to a second spool 316 which in the mode illustrated is the supply spool. This supply spool 316 is mounted on a spool mounting plate and shaft in similar manner to spool 308 and is connected for rotation with a right ribbon drive gear 317.

When the drive gear 301 is rotated in an anticlockwise direction, as seen in FIG. 10, by reversal of the direction of travel of the carriage 11, with the consequent reversal of the direction of rotation of pulley 207, the idler gear 302 will be driven to the right of slot 306 and will disengage from the left ribbon drive gear 307 with the consequence that no ribbon will be transferred from the supply to the take-up spool until the carriage once again reverses its direction.

The ribbon utilized in the printer is a standard multipass typewriter style ribbon having an eyelet adjacent each of its ends (only eyelet 318 adjacent the supply spool 310 is shown).

A slider element 319 is captively supported on the front plate 4 by means of elongate guides 310 and 315. The slider element 319 is slotted so that it can move longitudinally of the front plate 4 relative to guides 310 and 315 (as shown by arrows 320). As the ribbon 309 passes guides 310 and 315 it passes through narrow slots 321 and 322 formed between slider element 319 and guides 310 and 315 respectively. As the supply of ribbon 309 from the supply spool and 310 in FIG. 10 is almost exhausted the eyelet 318 will be drawn to the slot 322 where it engages the slider element 319 to move it to the right as seen in FIG. 10. The guides 310 and 315 in cooperation with the slider element 319 are arranged such that after a desired movement of the slider element by engagement with the eyelet 318, the associated slot (321 or 322) opens sufficiently to allow the eyelet to pass therethrough. Such a sufficient opening is shown at slot 321 in FIG. 10. A toggle link is pivotably mounted, by a pivot point 324 at one end, to the front plate 4. The other end of the toggle link 323 engages a notch 325 of the slider element 319. The toggle link 323 is pivoted about pivot point 324 during said desired movement of the slider element. A coil spring 326 under tension is fastened to the toggle link 323 and to the pivot link 303 at locations whereby as the slider moves past its central position to the right as shown in FIG. 10, the toggle link will also rotate past its central position and the spring 326 will go over center to pull the pivot link 303 to swing the idler gear 302 about drive gear 301 to bring it into mesh with the right ribbon drive gear 317 in which position counterclockwise rotation of the drive gear will move the idler gear 302 to he right (as seen in FIG. 10) in the slotted bearing hole 306 to bring it into engagement with the right ribbon drive gear 317. As a result of this toggle action change over, the spool 316 will become the take-up spool and now full spool 308 will become the supply spool with counterclockwise rotation of the drive gear 301 causing movement of the ribbon 309 through the printer and clockwise rotation of the drive gear 301 causing the idler gear 302 to move the left of the slotted bearing hole 306 to disengage the idler gear to the right ribbon drive gear 317.

Figure 12:
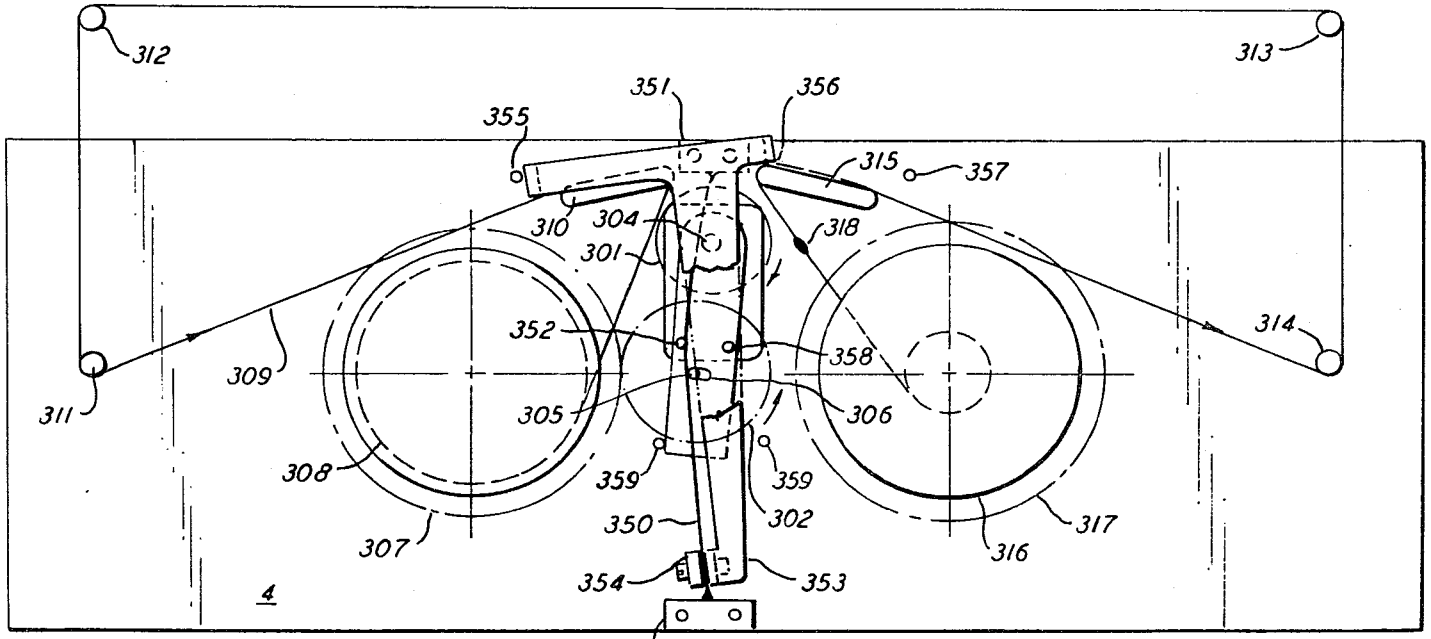
FIG. 12 is a diagrammatic partially broken away front elevation of a second embodiment of a ribbon drive of the printer of FIG. 1.

The end plates 2 and 3 are configured to provide ribbon guide surfaces to carry the ribbon from the ribbon drive mechanism to the space between the carriage 11 and platen 8. The second embodiment of ribbon drive mechanism is illustrated in FIG. 12. In this embodiment components similar to those of the first embodiment as illustrated in FIGS. 10 and 11 will be given the same reference numerals. Reference to FIG. 12 the ribbon drive mechanism is mounted on front plate 4 with pully 207 projecting to cooperate with cable 203 to receive drive therefrom. Rigidly connected for rotation with pully 207 is a drive gear 301. As, during operation, the carriage oscillates along shaft 7 from one end thereof to the other and back again, under the control of stepper motor 201, the pulley 207 and drive gear 301 will be turned alternately clockwise and counterclockwise. An idler gear 302 is held in mesh with the drive gear 301 by a pivot link 303 which is free to rotate about shaft 304 of the drive gear. The shaft 305 of idler gear 302 is captive in a slotted bearing hole 306 in the pivot link 303. The orientation of the slotted bearing hole is such that movement of the shaft 305 along this slot will not interfere with the constant mesh of the drive gear 301 and idler gear 302. The slotted arrangement for mounting the idler gear to the pivot link as observed in FIG. 12 results in the idler gear being moved to the left hand end of the slotted bearing hole 306 when the drive gear is rotated in a clockwise direction and this movement, when the pivot link 303 is in the position shown in FIG. 12, brings the idler gear into mesh with a left hand ribbon drive gear 307 to rotate that gear 307 in a clockwise direction. The left hand ribbon drive gear drives a ribbon spool drive plate and shaft upon which is mounted a ribbon spool 308. Rotation of ribbon spool 308 in a clockwise direction by the left hand ribbon drive gear 307 winds ribbon 309 onto this spool which in this mode acts as a take-up spool. For clarity FIG. 12 shows the ribbon path diagrammatically as passing over guides 310, 311, 312, 313, 314 and 315 to a second spool 316 which in the mode illustrated in FIG. 12 is the supply spool. This supply spool 316 is mounted on a spool mounting plate and shaft in similar manner to spool 308 and is connected for rotation with a right ribbon drive gear 317.

Operation of the gear spool drive arrangement described above with reference to FIG. 12 is substantially identical to that described with reference to FIGS. 10 and 11.

A spring flexure 350 is rigidly mounted to the front plate 4 by means of mounting blocks 351. As the spring flexure is longer than the spacing between its support by the blocks 351, it assumes a curved configuration either biased to the left as shown in FIG. 12 or biased to the right (not shown). When the flexure 350 is biased to the left it presses against a pin 352 on the pivot link 303 to bias this link to the left as shown in FIG. 12 into a position in which idler gear 302 will engage left hand ribbon drive gear 307 when shaft 305 is at the left hand end of the slotted bearing hole 306 while permitting the idler gear 302 to disengage from gear 307 when shaft 305 is at the right hand end of the slotted bearing hole 306.

Rigidly attached to the flexure 350 is an actuating arm 353 which is clamped to the flexure by means of a screw clamp 354. The curvature of the flexure 350 to the left, as shown in FIG. 12, holds this arm 353 to the left against a stop 355 which is fixedly attached to the front plate 4.

When the eyelet or rivet 318 of the ribbon 309 leaving the supply spool 316 engages a tang 356 on the actuating arm 353, this arm is caused to rotate in a clockwise direction as shown in FIG. 12 about the end of arm 353 adjacent the clamp 354. As the actuating arm is moved past its central position between stop 355 and stop 357, which is also attached to front plate 4, it will cause the flexure 350 to spring over center into a position in which it is biased to the right, in which position it will come into contact with pin 358 on the pivot link 303. Ribbon will continue to feed from supply spool 316 to take-up spool 308 and the rivet will pass under the tang 356 as it moves against stop 357 until the next carriage reversal of direction of oscillation, at which point tension on the ribbon ceases and the spring flexure 350 is able to exert sufficient bias to the right, as seen in FIG. 12, to move the pivot link 303 into a position in which it is biased to the right with idler gear 302 able to engage right hand drive gear 317 when shaft 305 is at the right hand end of slot 306, the spool 316 then becoming the take-up spool to receive ribbon from spool 308 (now the supply spool) when the drive gear 301 is rotated in a counterclockwise direction.

To ensure proper operation of the idler gear into and out of engagement with gears 307 and 317 by virtue of movement of shaft 305 along slotted bearing hole 306, stops 359 mounted on front plate 4 are provided. As shown in FIG. 12 the pivot link 303 is biased into engagement with left hand one of stops 359.

Except insofar as the description of the ribbon drive mechanism with respect to FIG. 12 conflicts with the operation of the ribbon drive mechanism illustrated in FIGS. 10 and 11, operation on both ribbon drive mechanisms (the first and second embodiments) is identical in principle.

Although the second embodiment of the ribbon drive mechanism has been described with the spring flexure 350, mounting blocks 351 and actuating arm 353 as separate components, it will be appreciated that within the scope of the present invention these three components could be incorporated into a single integral unit.

DOT MATRIX PRINTHEAD

The dot matrix printhead of the present invention has many advantages over the state of the art design currently used. These are principally in the area of initial cost and ease of repair. It uses inexpensive print wires, simple leaf springs and a simple arrangement of elements which can be readily assembled and repaired. For example, the whole print wire assembly can be removed and replaced without affecting the armature assembly.

In general, the print wire assembly preferably uses straight wires which have reinforced inner ends, the inner ends being those adjacent the armatures which drive the wires during the printing operation. Guide means surround these wires and are arranged so that the print wires extend along paths having an angle to the axis of the print head of three degrees or less. A single leaf spring having the requisite number of spring fingers is employed, each spring finger bearing on the outer portion of the reinforced section of the print wire. The leaf springs tends to force its associated print wire back against the driving armature and maintains the driving armature away from the solenoid core. The guide means comprises two sections, an inner guide means which can encompass the reinforced inner ends and an outer guide which is adjacent to the printing surface. In a preferred embodiment, a substantial portion of the inner guide means surrounds the reinforcing means to provide a very rigid structure to support the print wire so that it can be ballistically driven in a straight path by the impact of the armature.

A ring of solenoids surrounds the axis of the print head with the inner return path of the magnet circuit in the form of a concave section which also positions the individual armatures. In cooperation with this concave inner return path, there is provided an armature retaining cap which extends radially outwardly from the axis of the print head to hold the armatures in position. Suitable aligning means are included on the retaining cap, the leaf spring, the guide means and the guide means support, so that all of the elements can be simply and quickly assembled in their correct relative positions.

Figure 13:
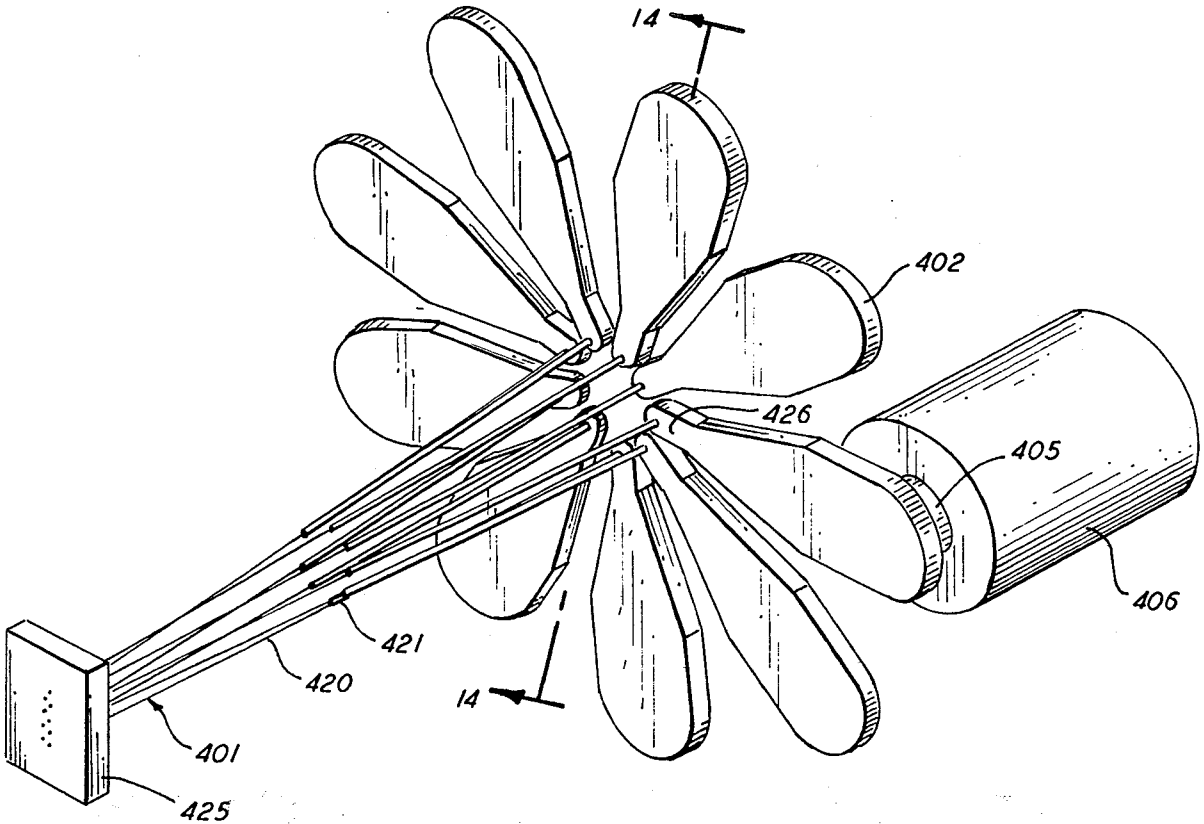
FIG. 13 is a diagrammatic perspective view of the general layout of a dot matrix printhead of the present invention.
Figure 14:
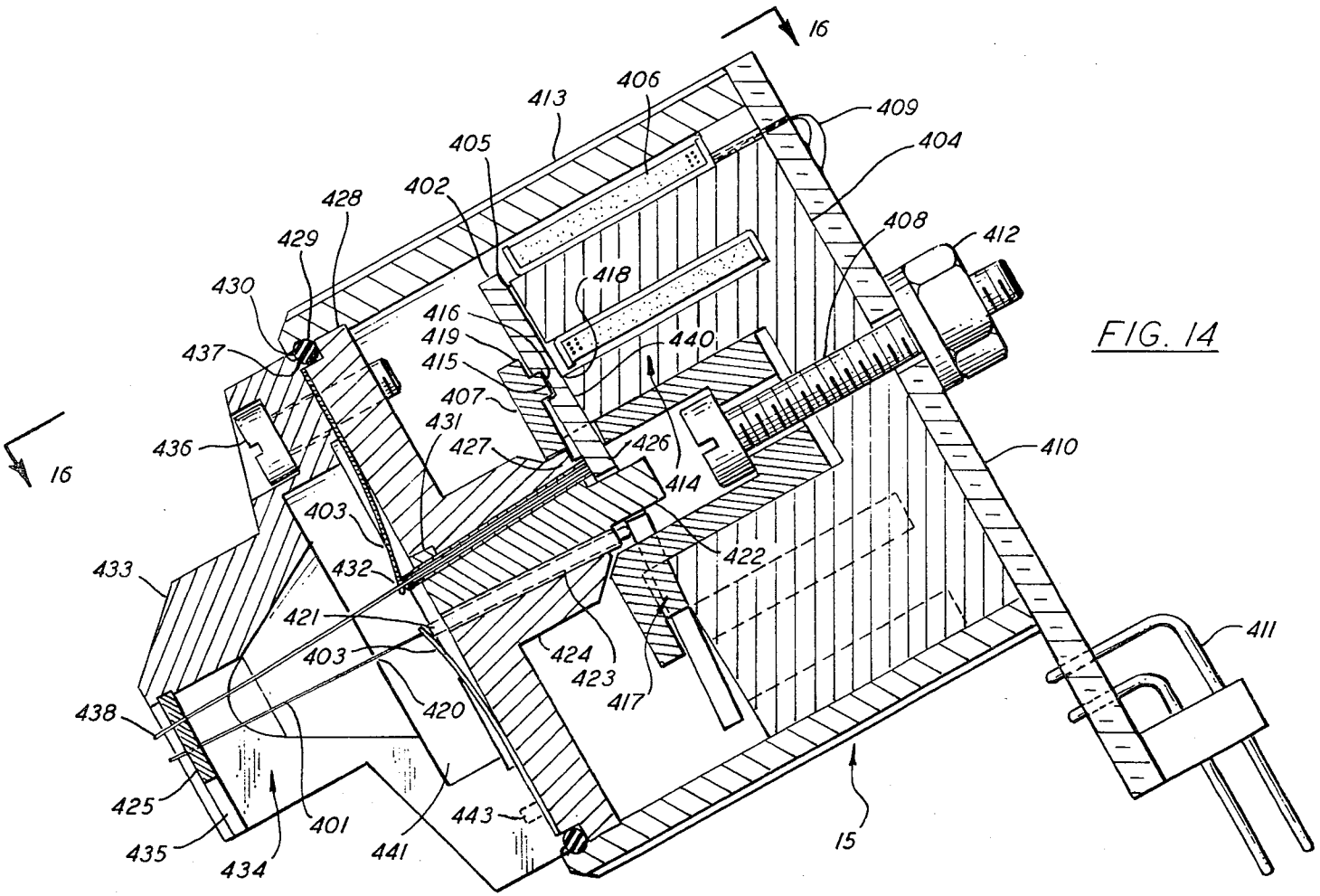
FIG. 14 is a sectional elevation on section line 14—14 of FIG. 13.

Referring now to FIGS. 13 and 14, the dot matrix print is generally indicated at 15. There are nine print wires 401 which are held against the tips 426 of nine solenoid armatures 402 by means of leaf springs 403. These springs are preferably in the form of an inverted daisy with the leaf springs extending inwardly toward the axis, the details of construction of the leaf spring being shown in FIG. 15.

The nine armatures 402 are held in place on a magnet assembly 404 which preferably comprises a one-piece structure having nine magnet cores 405 and nine actuating coils 406. The armatures 402 are retained in place by a means of an armature cap 407 and are held so as to pivot around an inward portion of the assembly during the wire driving motion. As can be seen, armature cap 407 has an inwardly extending central portion which is secured to the magnet assembly 404 by means of a screw 408. The power leads 409 to the actuating coils 406 are fed through holes in the magnet plate and are soldered or otherwise fastened to a circuit board 409 by a suitable electrical attachment. The circuit board 409, inturn, is secured by bolt 408 and nut 412 to the magnet assembly 404. Circuit board connectors 411 provides means for introducing electrical current to the actuating coils.

The various items described above, i.e. armature 402, core 405, solenoids 406, armature caps 407, bolt 408, circuit board 409, connectors 411, and nut 412 form a unitary assembly which inturn is pressed into a tubular and finned heat sink 413. This attachment to the heat sink 413 may be made by a metal to metal interference fit or can be made by a suitable structural adhesive, preferably one with high thermally conductive properties.

An important feature of the invention concerns the pivotal arrangement for the armatures 402. The magnet assembly 404 is preferably a one piece iron core with nine cylindrical cores 405 positioned radially outwardly from the axis and arranged around the axis in a circular pattern. A continuous ring 414 of iron is preferably provided for the flux return path axially inwardly of the ring of cylindrical cores. The top surface 440 of this return pole is concavely angled to define the rest position of the nine armatures. An embossement 415 on the armature cap fits loosely into a cavity 416 in each armature. The cap is provided with webs 417 which separate and guide the motion of the armatures.

The leaf springs 403, which loads the print wires 401 and forces them against the armatures 402, forces these armatures into the rest position as shown. The overhang 416 on the armature cap additionally helps to maintain the armatures in the position shown. Each armature is moved by energizing its coil 406, whereby it is attracted to the core 405 of the magnet and the armature pivots around the shoulder 418 of the inner core ring 414.

The print wires are fabricated by fusing wire 420 into fine nickel tubes 421. The wire may have a diameter of 0.0414 inches and the tubes may have an outside diameter of 0.030 inches. The inner wires are made of piano wire and the tubes are made of nickel. Both the wires and tubes are straight. The reinforcing tubes 421 are supported for nearly their entire length in an inner wire guide formed of a single conical plastic piece 422 having nine exterior grooves 423 which provide a straight line path for the wire from the circular array of armature tips to the nearly linear array of holes in the outboard wire bearing 425 (see FIG. 13). The periphery of the wire guide 422 is conical (although the pattern of grooves 423 is not) and mates with a conical hole in a wire housing 424. This feature provides a long surface bearing for the print wires while also adding stiffness to the wires and simplifying assembly of the wires. The cone angle, which is 3 degress or less, provides a lock fit so that once the housing 424 and guide 422 are assembled, they will not come apart without forcing. A key 431 carried by the inner guide 422 ensures correct orientation of the inner guide 422 with respect to housing 424.

The output configuration of the print wires is controlled by the angle of the grooves 423 and the wire guide 425 shown in FIGS. 13 and 14. The configuration illustrated is a staggered hole pattern, but obviously the invention is not limited thereto and it can be applied to an inline array of holes or other patterns of 7 or 9 wires, or more or less wires.

The outer guide or bearing 425 may be pre-assembled to the wires 401 before, after, or during assembly of the wire guides, and at this stage of assembly the position of the wire guide 425 on the wires 401 is not critical. Once the wires have been assembled into the outer guide 425, the inner guide assembly 422 and 424, this sub-assembly will remain together without the need for auxiliary holding devices such as tape, clamps, etc. This sub-assembly can be inserted into and mated with the aforementioned magnet and armature assembly. Conversely when the print wires have worn during use this print wire assembly can be readilly replaced without necessity of dissassembling the rest of the print head.

The proper orientation of the print wire inner guide assembly 422, 424 to the armature tips 426 is provided by a keying element 427 on the inner guide element 424 which engages a suitable slot in the armature cap 407. The inner guide assembly is centered by a close fit to the heat sink tube 413 in a groove 428 in the heat sink tube 413. A groove 429 is provided in the heat sink tube at the outer end thereof to receive an O-ring 430. The operation of the O-ring during assembly will be described later.

Figure 15:
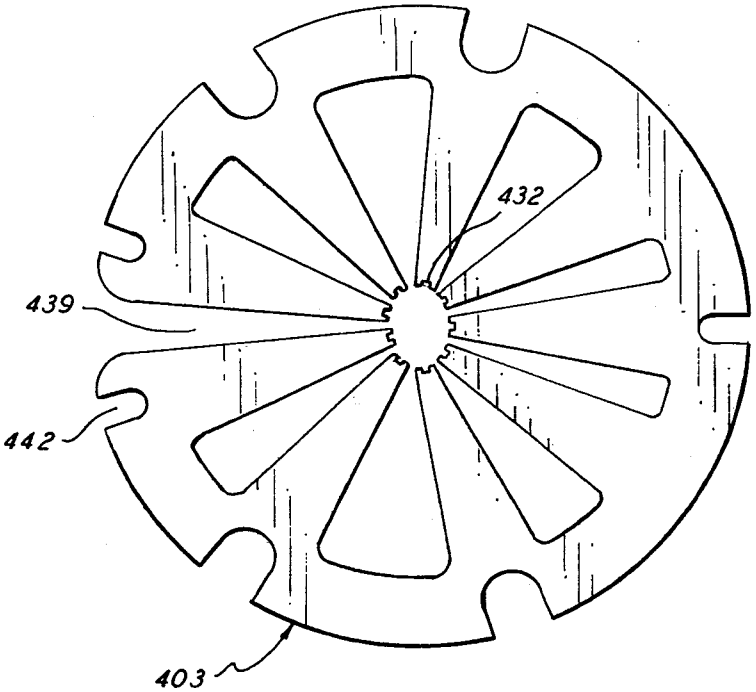
FIG. 15 illustrates the leaf spring used in the dot matrix printhead of FIGS. 13 and 14.

As shown in FIG. 15 the leaf spring means 403 is preferably formed in one piece and is slotted at 439 so that it may fit over the assembled print wire array. Three notches 442 in the spring mate with three pins (one being shown at 443 in ghost in FIG. 14) which are provided on the inner wire guide assembly 424 to properly orient the nine spring leafs to the nine print wires. Miniature clevis grooves 432 on the inner end of each leaf spring encircle the wire 417 and rest on the end of the steel tube 418, exerting pressure along the steel tubes so that the inner ends of the print wires bear against the armature tips 426.

A nose piece 433 is also slotted at 434 so that it too may be placed over the assembled wire/wire guide array. As nose piece 433 is being slid into place, the outer wire guide 425 can be adjusted forward to fit into a key groove 435 in the nose piece 433. Four screws 436 are used to fasten the nose 433 to the inner guide housing 424. There is a tapered surface 437 formed in this nose piece. As the fastening screws 436 are tightened, this tapered surface 437 forces the O-ring 430 into the groove 429 in the heat sink 413, making the head assembly complete and preventing outward movement of the inner guide assembly 424. The three keying pins 443 which orient the spring 403 also orient the nose assembly 424. The print wires are then ground and polished at their ends 431. This design and assembly procedure enables the use of print wires which are only approximately 0.020 inches longer than the final desired length, thereby facilitating grinding to length in a single operation.

In operation, as the print head traverses the paper, an appropriate array of solenoids 406 is actuated at desired print positions to cause the corresponding armatures 402 to pivot around the lip 418 thus driving the print wires in a straight line against the ribbon and the paper. After impact the wires rebound and together with the leaf springs drive the armatures back to the rest position shown in FIG. 14 where they are held by the leaf springs.

Figure 16:
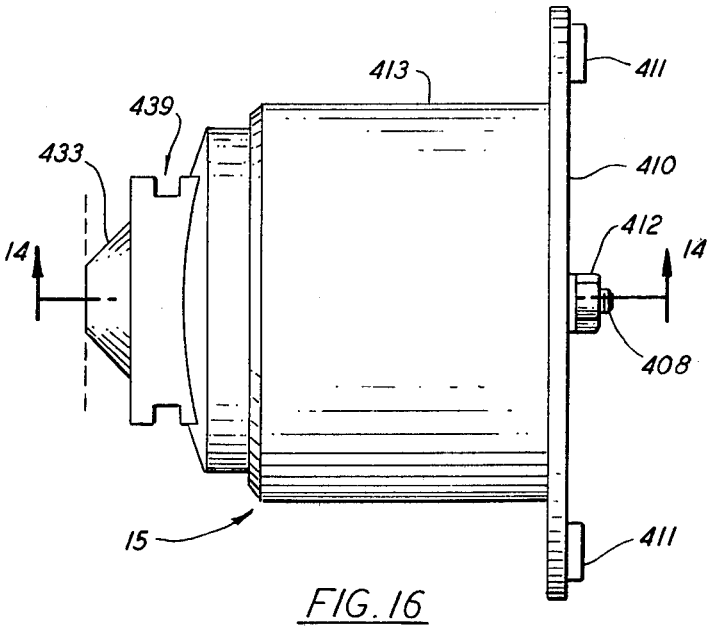
FIG. 16 is a plan view of the dot matrix printhead of FIGS. 13 and 14 as seen in the direction of arrows 16 in FIG. 14.

In order to provide for mounting of the dot matrix print head 15 on the supporting carriage 11, the print head nose piece 433 includes slots 444 (see FIG. 16) which mate with the guide bars 117 (see FIG. 6) on the supporting carriage 11. The nose piece is also provided with a recessed shoulder 441 (see FIG. 14) which is arranged to be engaged by fingers 119 (see FIG. 6) on the supporting carriage 11. As shown in FIG. 16 there are two connectors 411 which carry the power leads to the supporting carriage 11. These two connectors 411 also steady the dot matrix head 15 when they are inserted in their sockets (see FIG. 6). While the dot matrix printhead has been described as having straight print wires, it will be appreciated that they could be curved, at least at the ends reinforced with tubes, preferably with a constant radius, for cooperation with suitably formed guide grooves in the inner guide, so as to provide essentially parallel wire motion at bearing 425 while permitting armature tip 426 to operate at the wire tip circle diameter described.

It will also be appreciated that the reinforcing tubes 421 and the leaf springs 403 could all be integrally formed as one piece, by molding, from an internally lubricated plastic, about the print wires 401 with the leaf springs generally interconnected as shown in FIG. 15.

THE PRINTER SYSTEM

Figure 17:
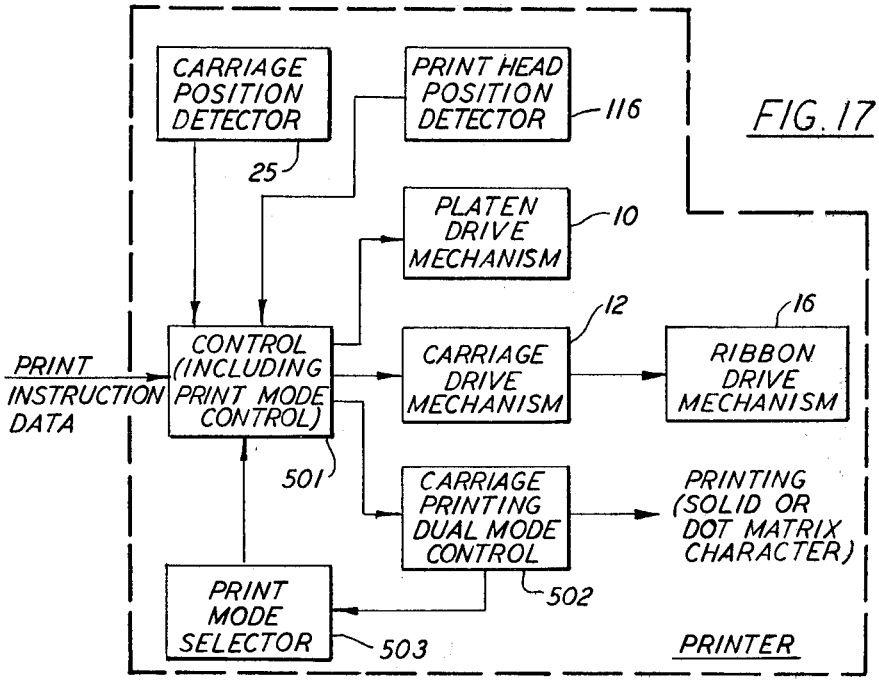
FIG. 17 is a diagrammatic block diagram of printer operation.

The printer system is shown diagramatically in FIG. 17. With reference to this figure, a control arrangement 501 receives data instructing the printer with respect to information to be printed by the printer and is connected to control the platen drive mechanism 10, the carriage drive mechanism 12 and the carriage printing dual mode control 502 in response to the print mode selected by print mode selector 503 the carriage position detector 25 and the print head position detector 116. A ribbon drive mechanism 16 is driven by the carriage drive mechanism 12. The carriage printing mechanism 502 and the print mode selector 503 have been described in detail above with respect to the carriage in the alternative mounting of printing elements associated therewith. The control arrangement 501 may include separate sections of solid character print control and dot matrix print control selected in accord with the desired printing mode in a manner which will be well understood by a man skilled in the art, or this arrangement may be an integrated circuit control system of new and unique design not forming a part of this application. The printer of the present invention can operate at between 15 and 20 characters/second in the solid character printing mode and in excess of 120 characters/-second in the dot matrix printing mode.

While the printer of the present invention has been described with respect to the use of a daisy wheel and a dot matrix print head, it will be appreciated that within the concept of the present invention the number of other solid character printing means may be utilized. For example, spherical, part spherical, annular, linear, character carrying elements could be utilized.

It will further be appreciated that also within the concept of the present invention, the concept of providing alternative of utilizing a solid character printing means and a dot matrix means could be achieved by mounting both a daisy wheel printing arrangement, or other solid character printing arrangement, and a dot matrix printhead on a carriage together. In such an arrangement the impact area of the solid character printing arrangement and dot matrix printing arrangement would, where the printing arrangements are in fixed relationship to the carriage, be spaced apart. The impact areas could be caused to coincide at the same point of the platen at the beginning of each print cycle by the use of switching means to select either solid character or dot matrix printing coupled with a two position carriage position detector, which in one position would place the impact area of the solid character printing at a desired location and which at the other position would place the dot matrix impact area at the same desired location.

Alternatively, also within the scope of the present invention, the solid character printing arrangement and the dot matrix printing arrangement could be simultaneously mounted on the carriage with provision being made for moving the printing arrangement to be used at any particular time to place its impact area at a desired single location.

We claim:

1. Apparatus, for a printer, comprising a carriage adapted to provide for a solid character printing mode of operation and a dot matrix mode of operation, and a selector operable to select a desired said mode, said carriage incorporating a solid character printing element drive mechanism and mounting means for detachably mounting a dot matrix printhead, wherein said printing element drive mechanism is for a daisy wheel and said mounting means provides alternative detachable mounting of said printhead and a hammer solenoid, said hammer solenoid, when mounted in said mounting means, being positioned to operate with a daisy wheel, when mounted to said element drive mechanism, to produce solid character print at a desired location and said dot matrix printhead, when mounted in said mounting means, being positioned to print at said desired location.

2. Apparatus according to claim 1 comprising control means responsive to selection of a desired said mode to operate said device.

3. Apparatus according to claim 1 wherein said carriage has a frame and said printing element drive mechanism comprises a stepper motor mounted on said frame to provide a stepped rotary output drive about a first axis, a daisy wheel mounting shaft mounted for rotation in said frame about a second axis, spaced from and parallel to said first axis, and a transmission to transmit drive from said stepper motor to said shaft to rotate said shaft at a rate lower than the rate of said rotary output drive.

4. Apparatus according to claim 3 comprising a daisy wheel position detector mounted on said carriage, said detector consisting of an opaque member having an opening therein and mounted for rotation by said shaft and a photosensitive detecting means positioned to detect said opening only at a precise rotary orientation of said shaft.

5. Apparatus according to claim 2 wherein said selector comprises connectors mounted on said frame to electrically interconnect a hammer solenoid and a dot matrix printhead, whichever is mounted to said mounting means, with said control means, the interconnection arrangement representing the selection of the desired said mode to which said control means responds.

6. Apparatus according to claim 5 wherein said connectors serve to mechanically steady the hammer solenoid and the dot matrix printhead when one of these is mounted in said mounting means.

7. Apparatus according to claim 1 wherein said mounting means comprises a pair of parallel spaced upstanding guide bars supported by said carriage and adapted to cooperate with guide means forming a part of said hammer solenoid and dot matrix printhead to position said solenoid and printhead at a desired location relative to said carriage.

8. Apparatus according to claim 7, comprising resilient latch means attached to said carriage and adapted to engage the one of the solenoid and printhead positioned by said guide bars, to resiliently latch said solenoid or printhead in said position.

9. A printer for printing in a solid character mode and a dot matrix mode as desired, comprising:

a printer main frame;

a platen mounted in said main frame;

an elongate carriage support rigidly mounted to said main frame parallel to said platen;

a guide rail in fixed spaced parallel relationship to said carriage support;

a carriage supported by said carriage support and said guide rail for movement therealong and guidance thereby respectively, said carriage having a solid character printing element drive mechanism and mounting means for a dot matrix printhead;

selector means operable to select a desired said mode; and a control means for operating said printer in accordance with the printing mode selected;

wherein said solid character printing element drive mechanism is a daisy wheel drive and mounting mechanism and said mounting means is adapted to receive a hammer solenoid for use in the solid character printing mode and, in the alternative, said dot matrix printhead for use in the dot matrix printing mode, said selector being responsive to the presence of said solenoid or printhead to provide said selection.

10. A printer according to claim 12 wherein a portion of said guide rail is mounted on a resilient member to resiliently bias said guide rail portion into position for said guidance and a lever operated cam engages said resilient member to move said portion of said guide rail out of engagement with said carriage.

* * * * *

UNITED STATES PATENT AND TRADEMARK OFFICE

CERTIFICATE OF CORRECTION

PATENT NO. : 4,444,519

DATED : April 24, 1984

INVENTOR(S) : Fred M. HOWELL, Theodore J. GOODLANDER, Duarte Miguel BRAZAO

It is certified that error appears in the above—identified patent and that said Letters Patent is hereby corrected as shown below:

Claim 1, line 45, delete the term "operate" and replace with "cooperate"

Claim 10, line 1, the number "12" should be "9".

Signed and Sealed this

*Fourteenth* Day of *August 1984*

[SEAL]

*Attest:*

GERALD J. MOSSINGHOFF

*Attesting Officer*

*Commissioner of Patents and Trademarks*